US006349736B1

(12) United States Patent
Dunmire

(10) Patent No.: US 6,349,736 B1
(45) Date of Patent: Feb. 26, 2002

(54) BACKFLOW PREVENTER APPARATUS AND METHOD WITH INTEGRATION OF SHUT-OFF VALVES

(75) Inventor: Charles W. Dunmire, Fresno, CA (US)

(73) Assignee: CMB Industries, Inc., Fresno, CA (US)

( * ) Notice: Subject to any disclaimer, the term of this patent is extended or adjusted under 35 U.S.C. 154(b) by 0 days.

(21) Appl. No.: 09/561,254

(22) Filed: Apr. 27, 2000

(51) Int. Cl.[7] ..... F16K 27/00; F16K 31/14

(52) U.S. Cl. ..... 137/15.19; 137/614.2; 137/454.6; 137/613

(58) Field of Search ..... 137/613, 614.2, 137/512, 454.6, 15.18, 15.19; 251/305

(56) References Cited

U.S. PATENT DOCUMENTS 3,770,014 A * 11/1973 Limberg ..... 137/614.2
4,284,097 A * 8/1981 Becker et al. ..... 137/512 X
5,031,661 A * 7/1991 Feuz ..... 137/614.2

OTHER PUBLICATIONS

"Specifications of Backflow Prevention Assemblies §10.1 General—Design and Materials Specifications and Laboratory Testing"; *USC Foundation for Cross–Connection Control and Hydraulic Research Manual*, 9th Edition, 1993, pp. 191–207.

* cited by examiner

*Primary Examiner*—Kevin Lee
(74) *Attorney, Agent, or Firm*—Sheridan Ross P.C.

(57) ABSTRACT

Backflow prevention is provided in connection with a device having one or more shut-off valves integrated with a double-check-valve backflow prevention device and/or housing. Preferably, a single housing encompasses two backflow preventer check valves, and upstream and downstream shut-off valves. Typically, end users cannot readily remove the shut-off valves (and/or their housing) from the backflow preventer check valves (and/or their housing). No flange or other connection between shut-off valves and backflow preventer check valves (and/or their housing) is required, reducing size, weight and labor requirements. The system can substantially reduce or eliminate potential for installation of double-check-valve backflow preventer devices without shut-off valves.

23 Claims, 8 Drawing Sheets

BACKFLOW PREVENTER APPARATUS AND METHOD WITH INTEGRATION OF SHUT-OFF VALVES

The present invention is directed to double-check-valve backflow prevention devices and methods of fabrication, assembly and use and in particular to backflow prevention which provides integration of shut-off valves.

BACKGROUND INFORMATION

Backflow prevention devices are devices configured to prevent or avoid flow of a liquid (typically water) in a direction opposite to normal-use flow directions. For example, backflow preventer devices may be installed between a municipal water supply and (all or portions of) a building's potable water system for the purpose of avoiding situations in which water within the building system might otherwise flow backwards into the municipal water system, potentially contaminating municipal water supplies. Backflow prevention can be of great importance in maintaining public health and safety and installation of backflow preventers is typically required by, e.g., building codes or other regulations, laws, etc.

A number of different kind of backflow prevention devices have been developed. Some devices are configured only for preventing a type of backflow that can result from gravity flow or siphoning in a backwards direction. These "anti-siphon" valves are often used in relatively less critical applications, such as in irrigation systems and may be implemented with a relatively inexpensive approach such as a pressure vacuum breaker (PVB) approach. Such PVB and/or anti-siphon devices are generally unsuitable for certain more critical application (e.g. connecting city water lines to a building) and typically (by statue, regulation, building code and the like) are not permitted to be used as backflow prevention devices for such critical applications.

In contrast, a more robust, reliable, often high-pressure, backflow prevention device is that known as a double-check-valve backflow preventer. Double check backflow prevention assemblies are described e.g. in publication 1015 of the American Society of Sanitary Engineers (ASSE) (Rev. 1993) incorporated herein by reference. In a double-check-valve backflow preventer, two valves are configured, typically in series, such that the valves are maintained open (against the urging of valve-closing springs or other devices). The double-check-valve backflow preventer is configured, however, such that if the pressure changes such that there could be a tendency for flow in the direction opposite to the normal or desired flow direction, one or both of the valve units will close, preventing such backflow. One example describing a double-check-valve backflow preventer arrangement is found in U.S. Pat. No. 5,107,888, incorporated herein by reference.

In some or all critical backflow prevention installations, there are additionally requirements to position two other valves, known as shut-off valves. In these situations, one shut-off valve is positioned upstream (from the point of view of normal flow direction) of the backflow preventer valves and another shut-off valve is positioned downstream of the backflow prevention valves. Shut-off valves can be useful, e.g., when it is necessary to perform inspection, maintenance, repair and/or replacement of a backflow preventer assembly or when it has been determined that a backflow preventer assembly has failed (or is in danger of failing), to avoid the risk of contamination.

In typical previous approaches, separate shut-off valve units were installed (often using a bolt and flange arrangement). Without wishing to be bound by any theory, it is believed that compliance with requirements for such upstream and downstream shut-off valves by installing separate shut-off valve units upstream and downstream of a preventer valve device has become common because shut-off valves are commonly used in situations in addition to backflow prevention and accordingly shut-off valves are available, for any of a number of different purposes in an "off the shelf" fashion. It is also believed (without wishing to be bound by any theory) that previous approaches which involve providing shutoff valves as separate units (with respect to the preventer assembly) were provided so that, in existing installations, the shut-off valves could be closed to permit ready isolation of the backflow preventer check valve (positioned between the two shut-off valves), e.g., for inspection, maintenance, repair, replacement and the like.

The common practice of (and, often, requirement for) installing separate shut-off valve units upstream and downstream of a preventer valve assembly is associated with a number of problems or disadvantages. The space requirements (including height requirements, width requirements, depth requirements and total volume requirements) in order to accommodate the separate shut-off valves and preventer valve assembly units can be undesirably large. This can be especially true when the shut-off valve is configured such that operation of the shut-off valves involves movement of handles or other control devices to a substantially new location, which must be accommodated when designing the space or volume which the shut-off valves will occupy. In some situations, including cold weather locations, separate enclosures must be provided for covering the backflow preventer valve/shut-off valve combination. In general, the cost of providing such separate enclosure is related to the enclosure volume and, accordingly, cost is increased by configurations having relatively large space or volume requirements.

Furthermore, the total weight of the backflow preventer valve/shut-off valve combination, including weight associated with flanges or other coupling devices, e.g., for coupling shut-off valves to backflow preventer valve assemblies, can provide an undesirable augmentation of costs, including costs of shipping, storage, installation and/or maintenance. Accordingly, it would be useful to provide a system apparatus and method to achieve compliance with backflow prevention design objectives and/or laws, codes or regulations while reducing space (height, width, depth and/or volume) requirements and/or weight of a backflow preventer/shut-off valve combination and preferably while still permitting at least some degree of inspection, maintenance, repair or replacement of backflow prevention components.

In some situations, it is found that backflow preventer assemblies are installed in the absence of one or both of the upstream and downstream shut-off valves, generally contravening good design practice and, usually, violating local codes, regulations, statues or the like. Accordingly, it would be useful to provide a system apparatus and method for backflow prevention which can substantially reduce or substantially eliminate the installation of backflow prevention assemblies in the absence of shut-off valves.

In previous approaches, provision of a backflow preventer assembly which was separate from upstream and downstream shut-off valves involved an undesirably lengthy installation procedure. In particular, in a typical situation, it was necessary to bolt a first shut-off valve flange to an inlet pipe flange, to bolt a first backflow preventer assembly flange to a second flange of the first shut-off valve, to bolt a first flange of a second shut-off valve to a second flange of the backflow preventer assembly, and to bolt a second flange of the second shut-off valve to an outlet pipe flange (not necessarily in that order). These steps also typically required positioning and alignment of various flanges while supporting the (often very heavy) shut-off valves and backflow preventer assemblies. Accordingly, it would be useful to provide a system method and apparatus which can reduce the cost and labor associated with installing a backflow preventer/shut-off valve combination.

Although, as noted above, shut-off valves are typically available "off the shelf" for use for numerous purposes, there can be undesirable costs associated with configurations which involve numerous separate parts. In previous approaches, the person designing, e.g., a building plumbing system, would need to spend time not only selecting, ordering and tracking a proper backflow preventer assembly, but also selecting, ordering and tracking two separate shut-off valves and, moreover, assure that the shut-off valves were sized and shaped for coupling to (and were otherwise compatible with) the backflow preventer assembly. Additionally, those who operate, inspect, maintain or repair such systems would need to learn and become familiar with repair maintenance and operation procedures for both a backflow preventer assembly and a separate shut-off valve, which may not necessarily be sourced from the same manufacturer. Furthermore, the previous approach required repair facilities or supply houses to stock multiple separate units. Accordingly, it would be useful to provide a method system and apparatus which can reduce the number of separate units which must be selected, shipped, maintained, and/or stocked.

SUMMARY OF THE INVENTION

The present invention includes a recognition of the existence, nature and/or source of problems associated with previous approaches, including as described herein. In one aspect, the present invention provides for a single housing which includes both first and second backflow preventer check valves and at least one (and preferably two) shut-off valves, all coupled to the same housing. Integration of shut-off valves into a double-check-valve backflow preventer housing eliminates the need for a separate coupling between a shut-off valve, housing and a double-check-valve backflow preventer assembly housing, which in turn permits the shut-off valves to be positioned relatively close to the double-check-valve backflow preventer components thus achieving a device which can have reduced size (i.e. reduced height, width, depth and/or volume) compared to a corresponding (e.g., similar capacity) unit using a separate shut-off valves. Eliminating the need for a flange (or other) coupler device or a coupler coupling step, for coupling a shut-off valve to a double-check-valve backflow preventer assembly, also reduces the overall weight of the system and the cost and time for installing the system. Units which integrate shut-off valves with double-check-valve preventer assemblies substantially eliminate the risk of installing a double-check-valve preventer assembly in the absence of shutoff valves. Integration of the device reduces the number of separate units which must be designed, selected, shipped, stocked, maintained and the like.

Preferably, the housing which encloses or couples the two backflow preventer valves and the (preferably two) shut-off valves, also provides access to the housing interior, such as by a removable plate, with the access preferably being sufficiently large to permit effective inspection, maintenance, repair and/or replacement of some or all of the backflow prevention components, such as the two check valves, e.g., while the shut-off valves are in a closed position.

In at least some embodiments, the shut-off valves are constructed such that operation of the shut-off valves, e.g. changing a shut-off valve from a closed to an open position, can be effected without substantially changing or increasing the height, length, width or volume requirements.

In one aspect, backflow prevention is provided in connection with a device having one or more shut-off valves integrated with a double-check-valve backflow prevention device and/or housing. Preferably, a single housing encompasses two backflow preventer check valves, and upstream and downstream shut-off valves. Typically, end users cannot readily remove the shutoff valves (and/or their housing) from the backflow preventer check valves (and/or their housing). No flange or other connection between shut-off valves and backflow preventer check valves (and/or their housings) is required, reducing size, weight and labor requirements. The system can substantially reduce or eliminate potential for installation of double-check-valve backflow preventer devices without shut-off valves.

DETAILED DESCRIPTION OF THE PREFERRED EMBODIMENT

Figure 1:
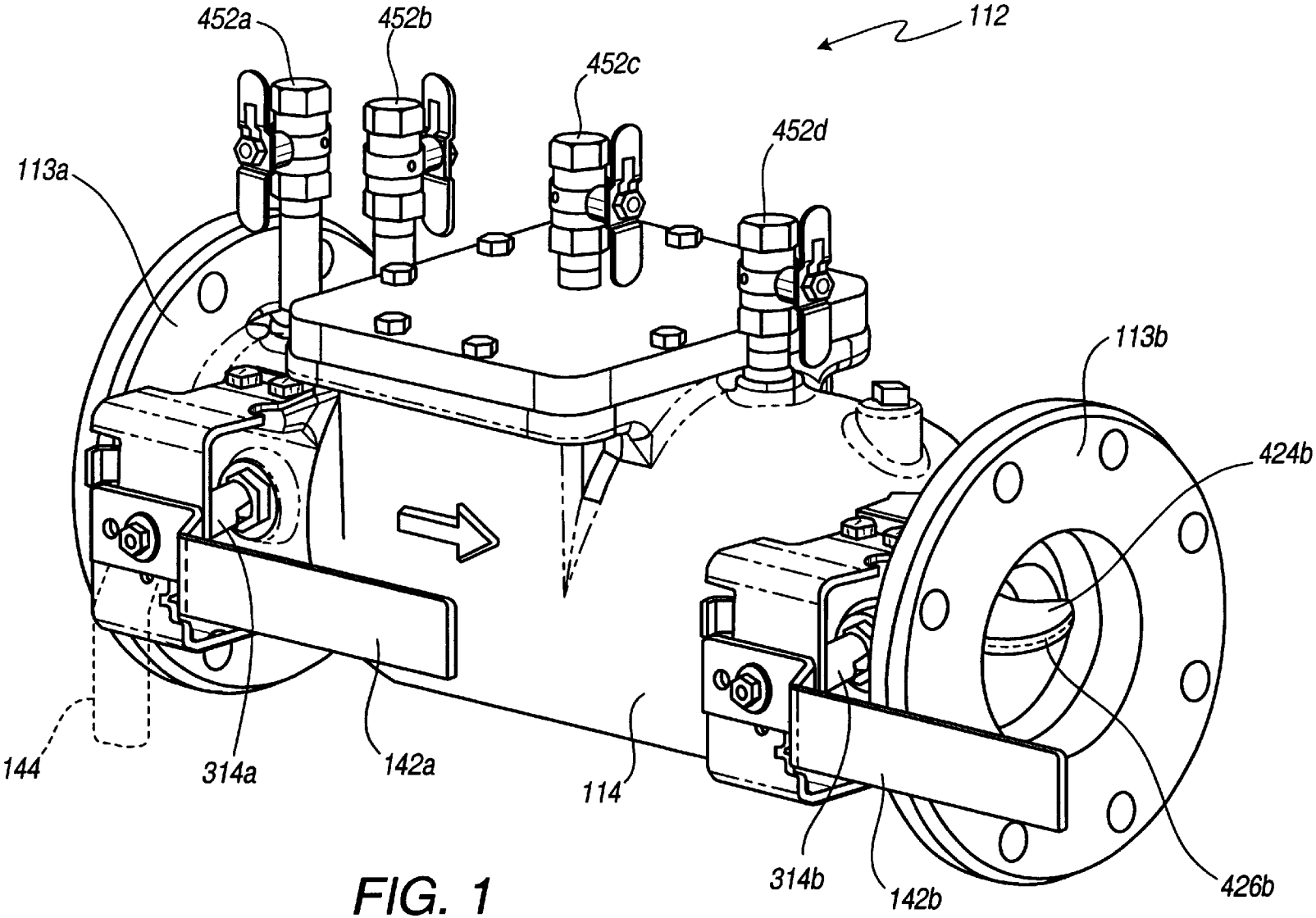
FIG. 1 is a perspective view of an integrated double-check-valve backflow preventer/shut-off valve device according to an embodiment of the present invention.
Figure 2:
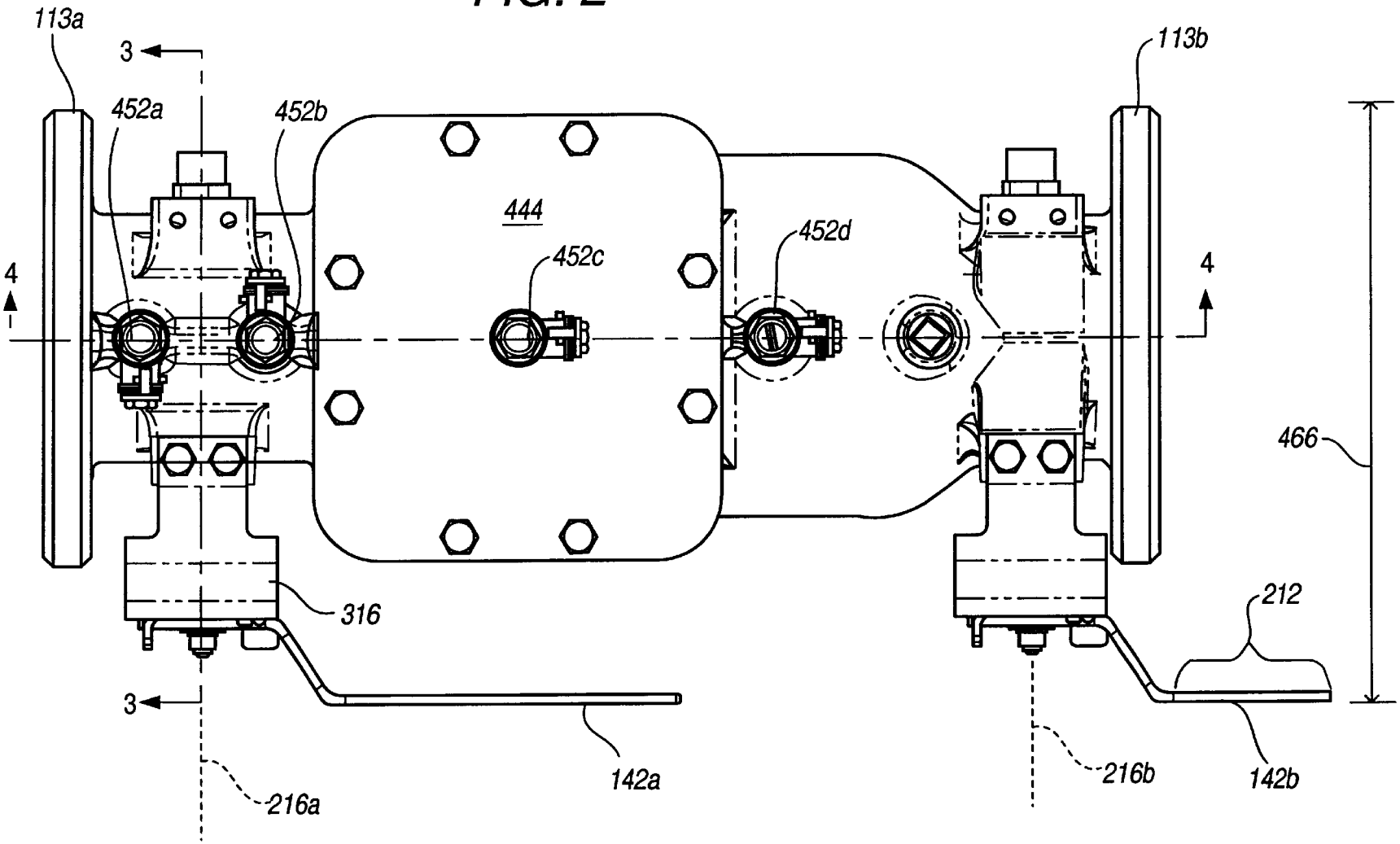
FIG. 2 is a top plan view of the device of FIG. 1.
Figure 3:
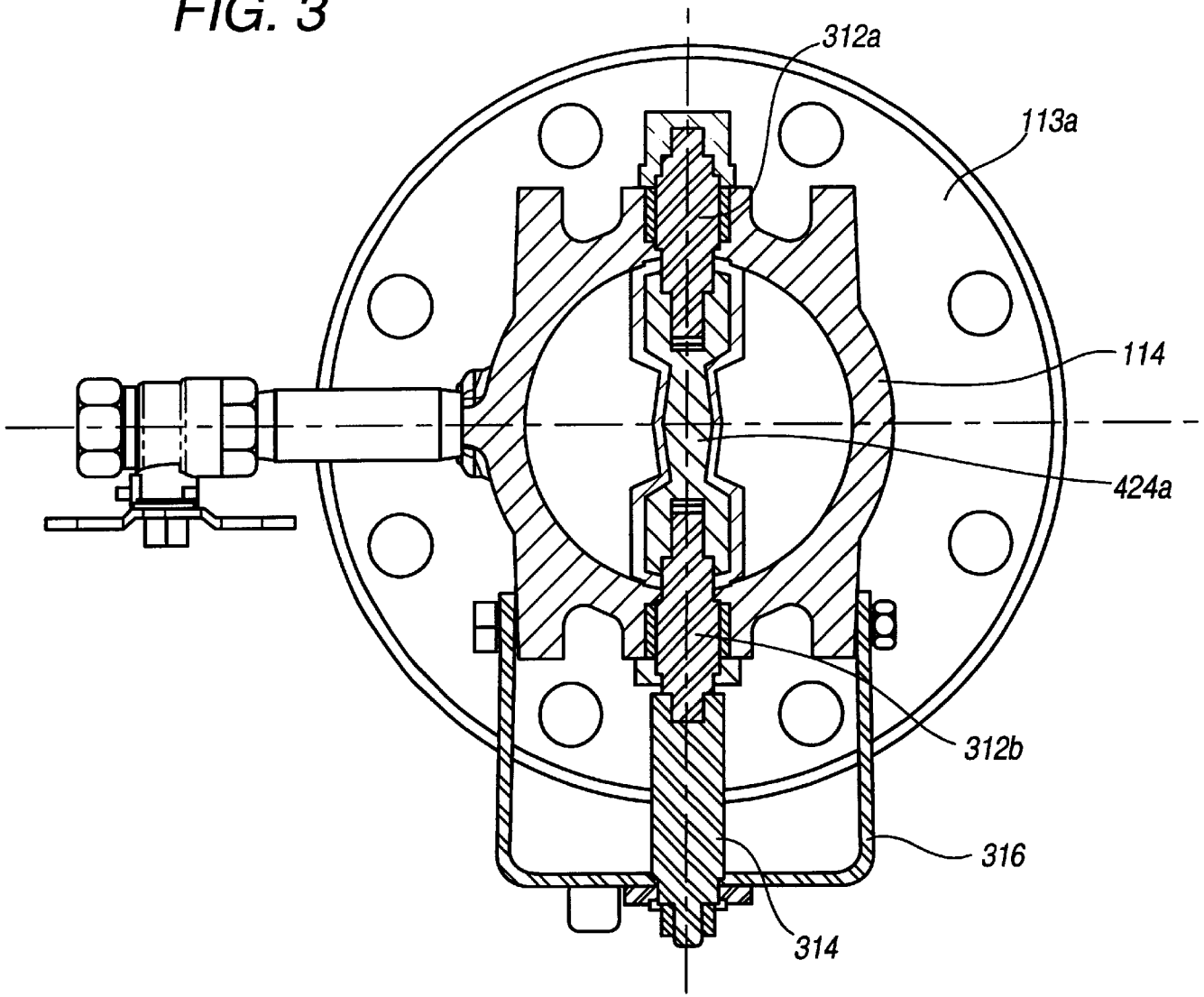
FIG. 3 is a cross sectional view taken along line 3—3 of FIG. 2.
Figure 4:
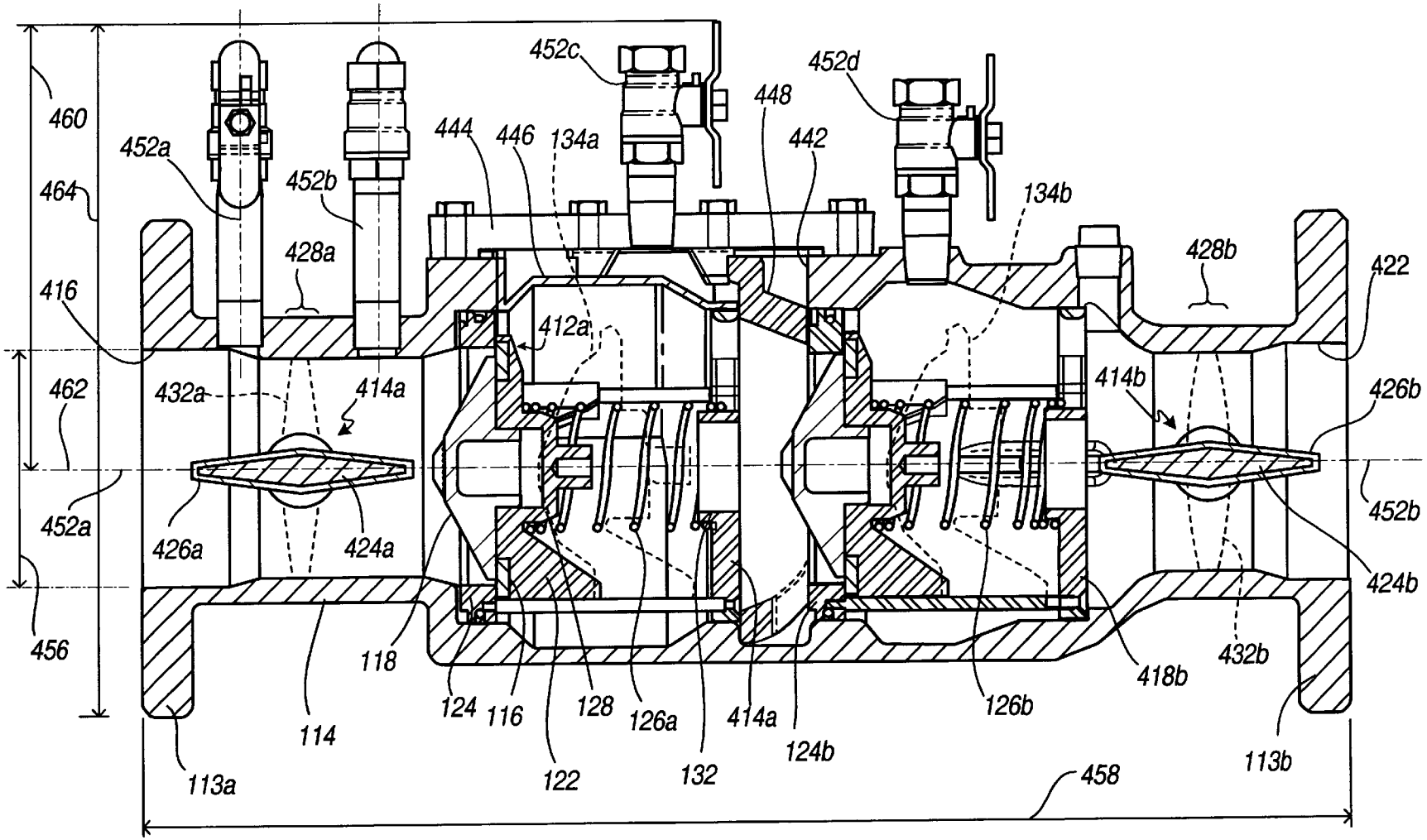
FIG. 4 is a cross sectional view taken along line 4—4 of FIG. 2.

In the embodiment depicted in FIG. 1, a double-check-valve backflow preventer device with integrated upstream and downstream shut-off valves 112 uses a single housing 114 to enclose both first and second backflow preventer check valves 412*a,b* and first and second shut-off valves 414*a,b* (FIG.4). In the depicted embodiment, the device 112 is provided with inlet and outlet flange plates 113*ab* for connecting the unit, preferably in line, to water inlet and outlet pipes (not shown) respectively. The shut-off valves 414*ab* are integrated with the backflow prevention components at least in the sense that in the device, as installed, there is substantially no opportunity for the end user to separate at least one of the shut-off valves 414*a* (and/or the housing portion enclosing the shut-off valve) from at least one of the backflow preventer check valves 412*a* (or the housing enclosing the check valve). For example, in the embodiment of FIGS. 1–4, there is a single housing 114 which encompasses both backflow preventer check valves 412*a,b* and the shut-off valves 414*a,b* and thus, the end user cannot readily separate, e.g., the first shut-off valve 414*a* from the first backflow preventer valve 412*a* (other than by, for example, cutting the housing 114). This is in contrast with a non-integrated approach in which a separate shut-off valve with a separate housing was coupled, usually by a bolt and flange coupling, to a separate backflow preventer housing such that, the assembly, as installed, permitted separation of the shut-off valve from the backflow preventer assembly by unfastening the bolt and flange (or other) connector. Elimination for the need for a flange (or other coupling) for connecting a shut-off valve to a backflow preventer assembly reduces the overall weigh of the device and the overall width of the device.

The present invention can be used in connection with devices that use any of a number of different types of double-check-valve backflow preventers. In the depicted embodiment, a seat disk 116, positioned between a disk retainer 118 and a disk holder 122 is urged toward a closed or sealing configuration (as depicted in FIG. 4), with a surface of the seat disk 116 in sealing contact with a seat ring 124, by a check spring 126*a,b* positioned between a holder boss 128 and an outlet cage boss 132. During normal flow, water pressure provides for positioning of the valves 412*a* 412*b*, against the urging of the check spring 126*a,b*, to an open position (depicted in phantom 134*a,b*).

When the preventer valves are in the open positions 134*a,b* and the shut-off valves are in the open position (as depicted in FIG. 4), flow, in the depicted embodiment, is through the inlet opening 416, past the first shut-off valve 414*a*, through the opening defined by the seat ring 124, past the first (open) backflow preventer check valve 134*a*, through the outlet cage 418, through the opening defined by the second seat ring 124*b* past the second (open) backflow preventer check valve 134*b*, past the second outlet cage 418*b*, past the second shut-off valve 414*b* and out the outlet opening 422. If pressure changes in such a fashion that there is a risk of flow in the opposite direction (i.e., from the outlet opening 422 towards the inlet opening 416) one or both of the backflow preventer valves will be moved by the check spring 126*a,b* to the closed position 412*a,b*.

In the depicted embodiment, the shut-off valves 414*a,b* are substantially manually operated. The shut-off valves 414*a,b* in the depicted embodiment, are butterfly valves. Butterfly valves (and other terms of interest) are described in Section 1.2 ("Definitions") of publication C504-94 of American National Standards Institute (ANSI/AWWA) incorporated herein by reference. Each valve includes a valve plate 424*a,b* having a perimeter 426*a,b* sized and shaped to sealingly meet the edge of a conduit portion 428*a,b* when the plates 424*a,b* are rotated, about rotation axes 216*a,b* from the open configuration to a closed configuration (depicted in phantom 432*a,b*). The plates 424*a,b* are mounted to permit rotation from the open configuration 414*a,b* to the closed configuration 432*a,b*, in the depicted embodiment, by being mounted on first and second shafts 312*a,b* received in (substantially sealed) openings or pockets formed in portions of the housing 114. Although the present invention can be implemented using any of a plurality of different valve devices for shut-off valves, it is believed that the relatively light weight of a butterfly valve (e.g., as compared to a gate valve, commonly used in previous approaches) is advantageous in assisting in the reduction of overall weight of the device. At least one of the shafts 312*b* is coupled to a lever shaft 314*a,b* having a free end supported by a mounting bracket 316 and coupled to a lever handle 142*a,b*. When an operator rotates a handle 142 from a first position to a second position 144 (FIG. 1), the resultant rotation of the lever shaft 314 and the disk shaft 312*b* causes the disk or plate 424*a* to rotate from the opened configuration 424*a* to the closed configuration 432*a*, preventing flow past the shut-off valve.

In the depicted embodiment, the housing 114 is provided with at least a first access opening 442 covered (preferably in a sealing fashion) by a removable, e.g., bolted-on, cover plate 444. The access opening is sized and shaped to permit inspection, maintenance, repair and/or replacement of some or all components of one or, preferably both, of the check valves 412*a* 412*b* and associated parts. In at least one embodiment, the access opening has a size and shape at least equal to a profile of one of the backflow preventer valves so as to permit the backflow preventer valve to pass through the access opening, e.g., for replacement. For example, in the depicted embodiment, after removing bolts and removing the cover plate 444, it is possible to remove a flow insert 446 to substantially gain access (for inspection, repair, replacement and the like) to the first backflow prevention valve 412*a*. Depending on the type of access needed, accessing the second backflow prevention valve 412*b* may involve removing a spacer 448, second seat ring 124*b* and the like. By providing a configuration that provides sufficient access to achieve inspection repair, maintenance and/or replacement of one or both of the backflow preventer check valves 412*a,b*, the present invention makes it feasible to integrate the shut-off valves 414*a,b* with the backflow preventer assembly while still allowing end users to perform at least some maintenance, inspection and repair and/or replacement of double-check-valve backflow preventer components.

In the depicted embodiment, the integrated backflow preventer/shut-off device 112 includes a plurality of nipples 452*a,b,c,d,* any or all of which may be provided with a valve such as a ball valve, and which may be used for any of a number of purposes including installing gauges or test devices, safety or vent devices, bypass devices, warning devices and the like.

In use, an assembled device 112 has the inlet flange 113*a* coupled to a corresponding flange of a supply pipe (not as shown) and has the outlet flange 113*b* coupled to a corresponding flange of an outlet pipe, e.g., using bolt connections. The lever 142*a,b* for the shut-off valves would be positioned to place the shut-off valves in opened configurations 424*a,b* and flow from the source would provide pressure sufficient to retain the backflow preventer valves in the open position 434*a,b* with check springs 126 configured to move the preventer valves to the closed configuration 412*a,b* in the event of a pressure situation which raises the risk of backflow (such as pressure at the outlet exceeding pressure at the inlet). Accordingly, it can be seen that a device according to the present invention can be installed, providing the (typically required) upstream and downstream shut-off valves, by a process which involves only two coupling operations, viz. coupling the device inlet coupler 113*a* to a supply pipe and coupling the device outlet coupler 113*b* to an outlet pipe.

Although a number of configurations are possible, the in-line configuration with a substantially straight average streamline path from the (substantial) center of the inlet opening 452*a* to the (substantial) center of the outlet opening 452*b*, and/or with the four valves 414*a*, 412*a*, 412*b*, 414*b* substantially linearly arranged, is believed useful in both providing reduced spaced requirements and in avoiding undue and undesirable pressure loss as fluid flows through the device.

A number of materials can be used in connection with constructing a device according to embodiments of the present invention. Typically, the housing 114, the body of the plates 424*a,b* carriers or holders 118, 122 inserts 446, spacers 448, cover plate 444, and the like, will be made of a metal, typically steel. The seat ring 116 will typically be made of a resilient material such as a rubber or plastic. The materials and selected will typically be affected by factors such as anticipated operating conditions (such as pressures, temperatures and the like) as will be understood of those of skill in the art after understanding the present disclosure.

The size or dimension of a device 112 or components thereof will depend on a number of factors, and especially the inlet and outlet diameter 456, anticipated pressure and/or flow rate, and the like. As one example, for a device 112 configured for a four-inch inlet opening 456 and configured for normal building water supply purposes and pressures, a device can be configured having a total length 458 of about 22 inches (about 55 centimeters) a maximum diameter (with respect to the flow center line 462) 460 of about 7.9 inches (about 20 centimeters) a total height 464 of about 12.5 inches (about 32 centimeters) and a total depth 466 of about 11.7 inches (about 30 centimeters). In this regard, it is believed the present invention can facilitate providing a device having a height, width, depth or total volume requirement which is substantially less than height, width and depth required using previous approaches for corresponding function and capacity (inlet diameter, flow rate and/or pressure).

FIGS. 5–9 illustrate an embodiment in which operation (opening and closing) of the shut-off valve is provided by operation of hand wheels 512*a*, 512*b* (as opposed to levers 142*a*, 142*b* of the embodiment of FIGS. 1–4). Other than as described below, the configuration of the housing 114 and the enclosed shut-off valves and backflow preventer check valves 424*a,b* are substantially the same as described in connection with the embodiment of FIGS. 1–4.

Figure 5:
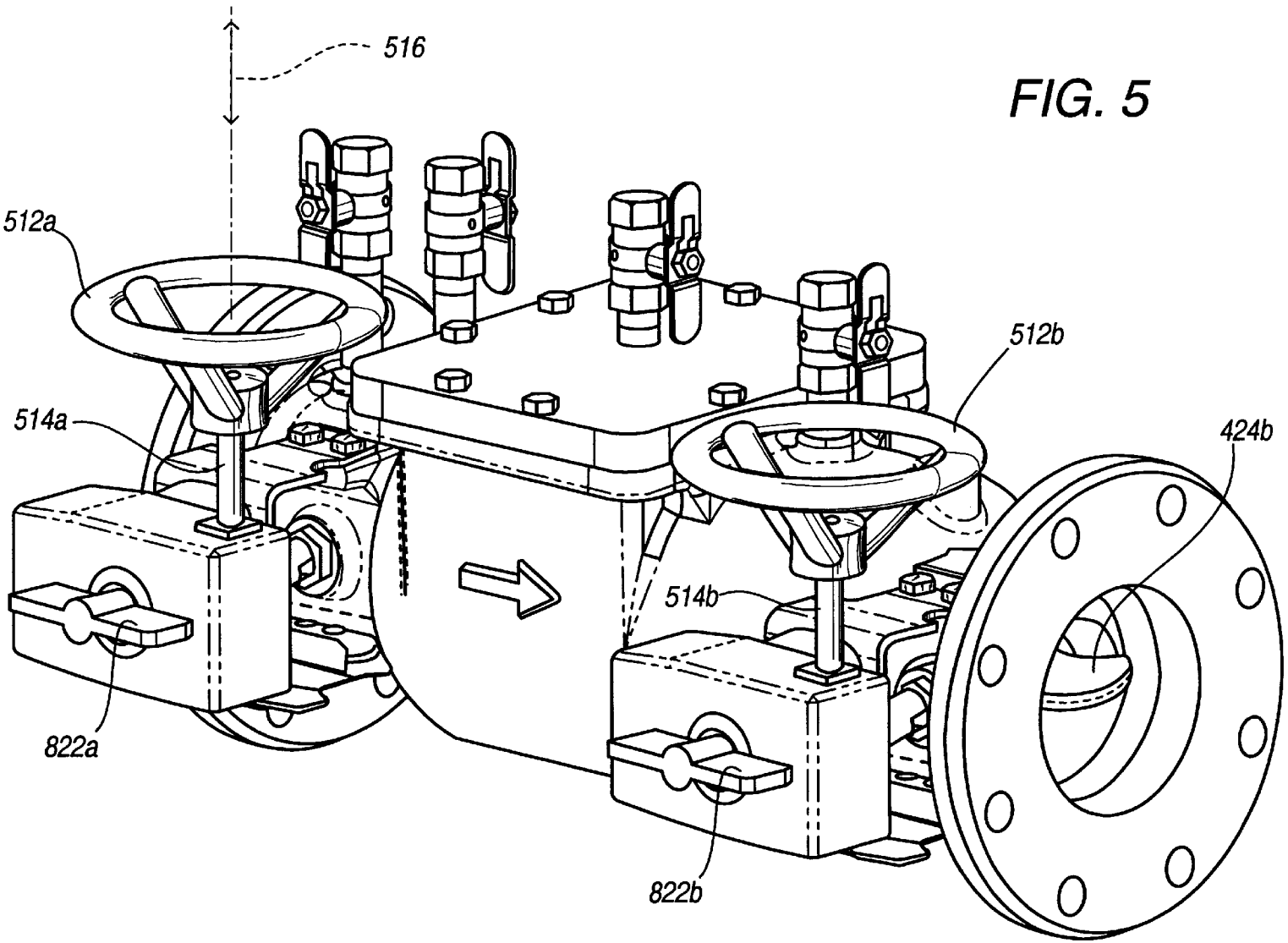
FIG. 5 is a perspective view of a double-check-valve backflow preventer/shut-off valve device according to an embodiment of the present invention.
Figure 6:
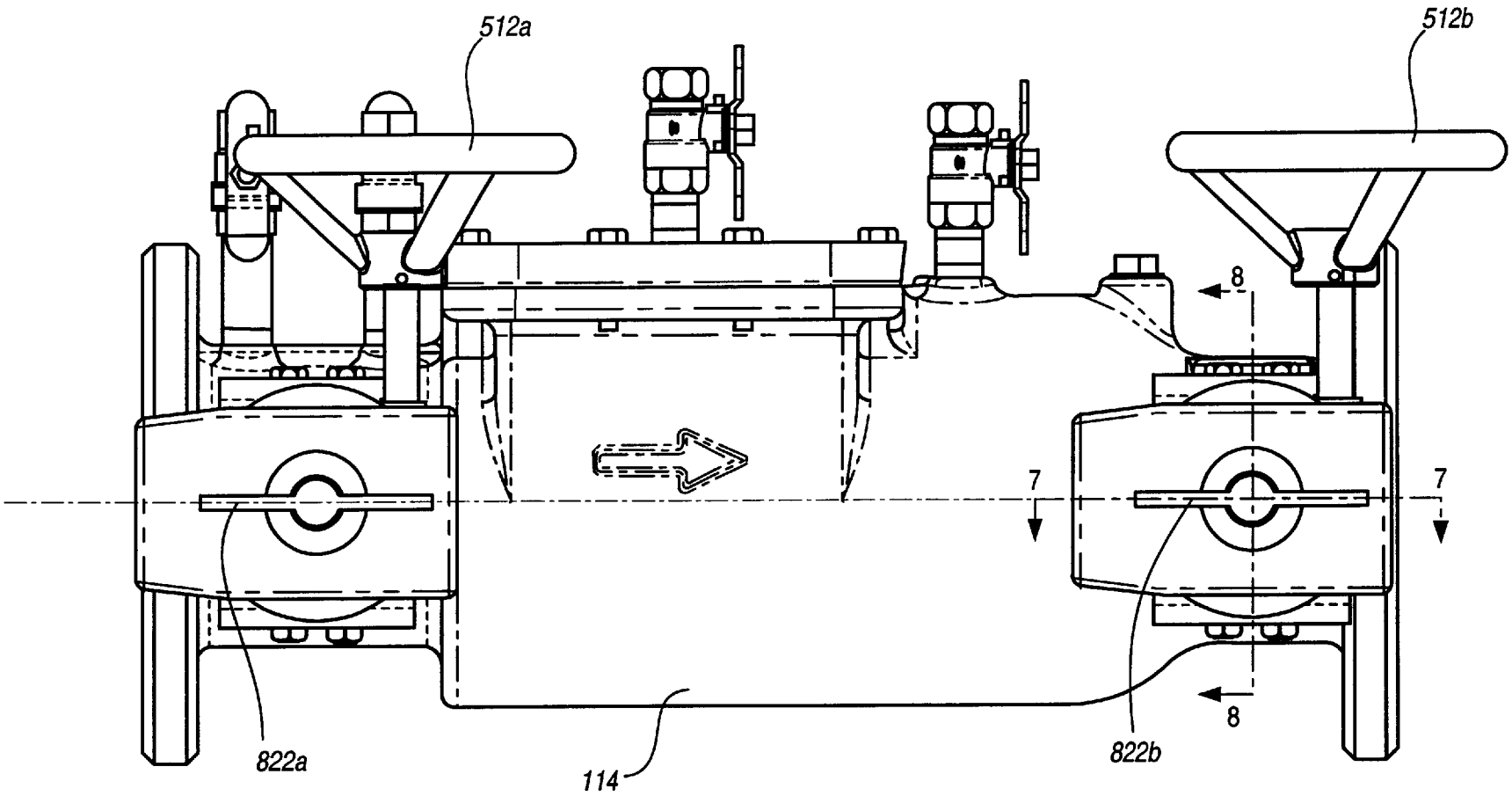
FIG. 6 is a front elevational view of device of FIG. 5.
Figure 8:
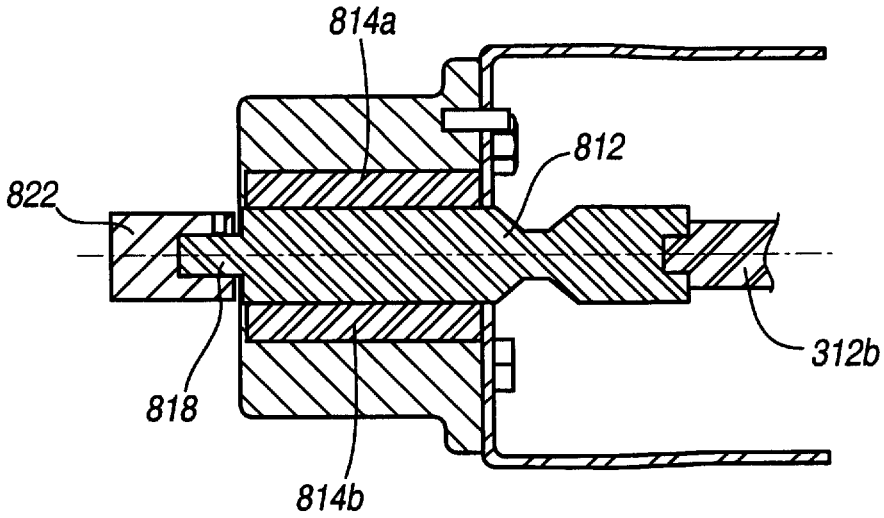
FIG. 8 is a cross sectional view taken along line 8—8 of FIG. 6.
Figure 7:
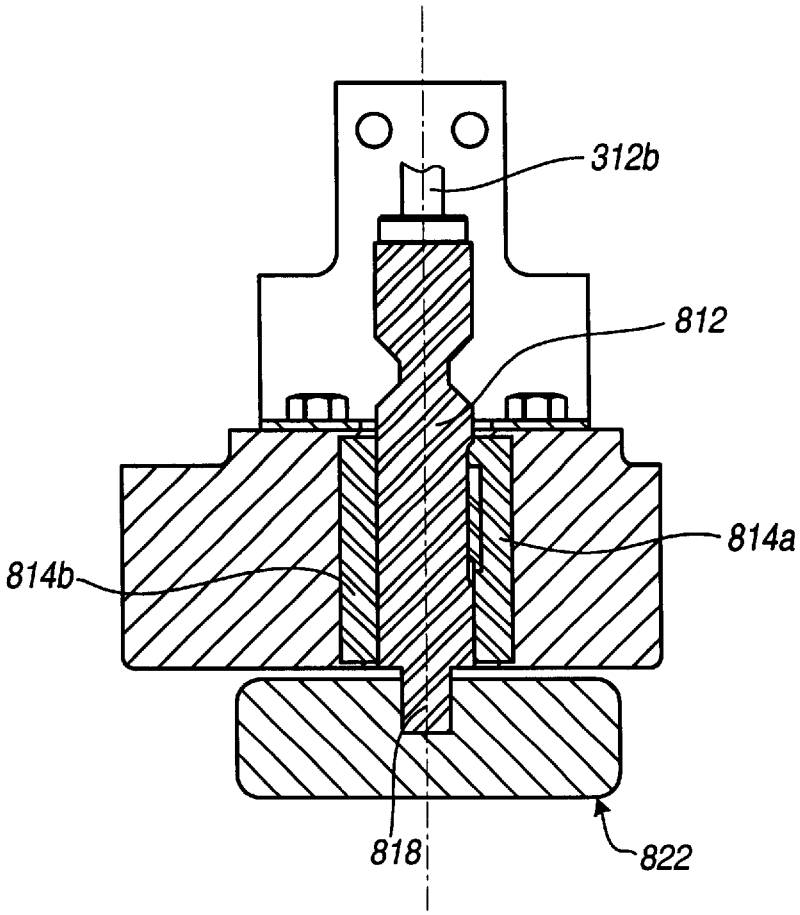
FIG. 7 is a cross sectional view taken along line 7—7 of FIG. 6.
Figure 9:
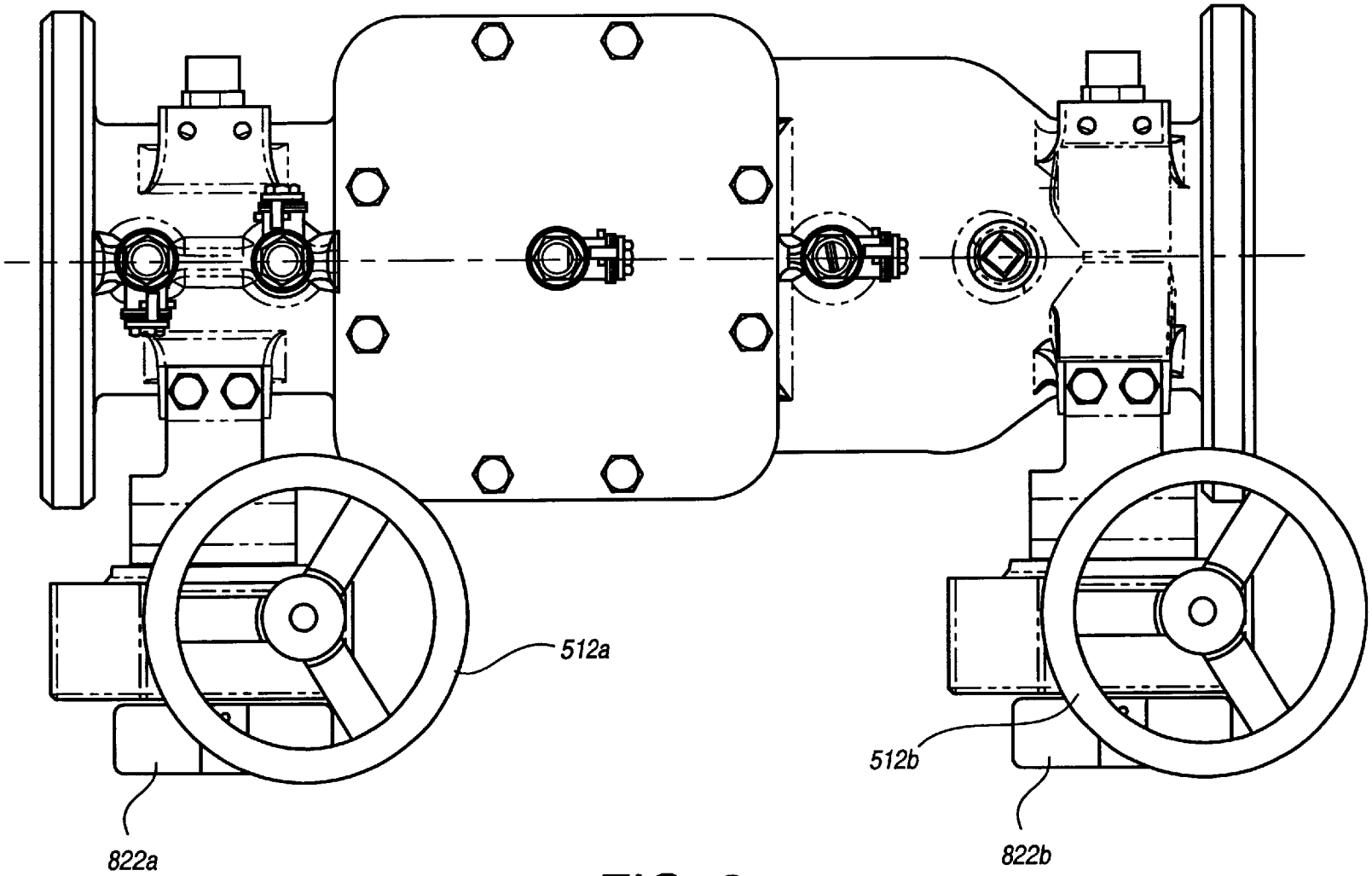
FIG. 9 is a top plan view of the device of FIG. 5.

In the embodiment of FIGS. 5–9, the shut-off valve shaft 312 is coupled to a toothed gear shaft 812 configured for interacting with teeth 814*ab* driven by rotation of a perpendicular handwheel shaft 514*a*, 514*b*. Those of skill in the art will understand various manners of constructing gear trains in a fashion such that rotation of hand-wheel shafts 514*a,b* will drive rotation of a perpendicular toothed shaft 812, e.g., to rotate the disk shaft 312*b*. The free end 818 of the toothed shaft 812 is coupled to a position indicator plate 822*a,b*. In this way, when the indicator plates 822*a,b* are in a configuration parallel to the flow direction as depicted in FIG. 5, the shut-off valves are known to be in the open position. An orientation of the indicator plates perpendicular to flow direction 822*ab* is an indication that the shut-off valves 414*ab* are in the closed configuration 432*ab*. Use of the hand-wheel configuration of FIGS. 5–9 avoids the need for accommodating a portion 212 (FIG. 2) of a handle which may extend laterally beyond the position of the outlet flange 113*b* (and thus effectively increase in the overall length of the device which must be accommodated, e.g., in an enclosure or a building space.) Preferably, the gear train is configured such that rotation of the hand-wheels 512*a,b* causes opening or closing of the shut-off valves without (or with little) axial movement 516 of hand wheels (thus reducing the amount of space or volume that must be accommodated, e.g., in a building space or enclosure), e.g., compared to certain gate valve or other valve configurations in some prior shut-off valves which involved axial movement of a hand wheel or similar control. The configuration of FIG. 5, with the hand wheel shafts 514*a,b* perpendicular to the axis of the shut-off valve shaft 312*b* can be useful, e.g., when a backflow preventer is to be accommodated in space such that operation from above is most convenient. Those of skill in the art will understand how to configure gear trains to configure hand-wheels 512*a,b* or other controls for situations when access from the side, bottom or ends is more convenient.

In light of the above description, a number of advantages of the present invention can be seen. The present invention can assist in reducing the size (height, width, depth and/or volume requirements) for a double-check-valve backflow preventer/shut-off valve combination and/or enclosures or building spaces therefore including, in some cases, below grade valve vaults. The present invention can provide double-check-valve backflow preventers (shut-off valve combinations which have reduced weight compared to previous approaches (for similar-capacity combinations). The present invention can reduce the cost or labor involved in installing double-check-value backflow prevention/shut-off valve combinations, including reducing the number of couplings or other steps and/or the size or weight of devices to be supported or positioned during installation, compared to prior installation of similar-capacity devices. The present invention can assist in reducing pressure loss in a double-check-valve backflow preventer/shut-off valve combination. The present invention can reduce or eliminate instances of double-check-valve backflow preventers being installed without shut-off valves. The present invention can provide some or all of these advantages while still permitting effective access to the check valve or other components, e.g., for inspection, maintenance, repair or replacement, e.g., while flow is shut-off using shut-off valves. The present invention can provide enhanced flexibility by providing numerous different manners of orienting, positioning or providing shut-off control handles or similar devices.

A number of variations and modifications of the present invention can be used. It is possible to use some features of the invention without using others. For example, it is possible to provide for integration of one or more shut-off valves with a double-check-valve backflow preventer device without being restricted to the use of a butterfly valves as the shut-off valve type. Although depicted embodiments show the integrated shut-off valves being positioned in-line with the backflow preventer check valves, it is possible to position one or both of the shut-off valves off-axis such as above, below, in front of or behind the plane or axis defined by the two check valves. Although a configuration having two check valves substantially on-axis has been depicted, other preventer valve configurations can be used in connection with embodiments of the present invention including angled check valves, orthogonal check valves and the like. Although the present invention provides integrated shut-off valves, there is no theoretical reason why a device according to the invention cannot be installed in conjunction with separate, additional shut-off valves, if desired, e.g., for failsafe or "redundant" shut-off functionality. Although embodiments of the present invention provided for integration of two shut-off valves, one upstream and one downstream, with a backflow prevention assembly, it is also possible to provide embodiments in which only one shut-off valve is integrated or in which there are three or more integrated shut-off valves. Although a butterfly valve has been described for use as a shut-off valve and is generally preferred, since it has certain advantageous aspects, including small size and weight, at least some features of the present invention can be provided using a number of other types of valves can be used for shut-off purposes including, e.g., a globe valve, a gate valve, a poppet valve, a disk valve, a flapper valve and the like.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A double-check-valve backflow preventer apparatus, comprising:

first and second backflow prevention check valves;

first and second shut-off valves;

a housing encompassing said first and second backflow prevention check valves and said first and second manually operable shut-off valves, to define a flow path from an inlet opening of said housing, having an upstream pressure, past said first shut-off valve, past said first check valve, past said second check valve, past said second shut-off valve to an outlet opening of said housing, having a downstream pressure;

said check valves being configured to move from an open configuration to a closed configuration if said upstream pressure is not at least a predetermined amount greater than said downstream pressure;

said housing being substantially integral wherein a housing portion encompassing at least one of said first and second shut-off valves can not be separated from a housing portion encompassing at least one of said check valves without cutting said housing;

a scalable access opening in said housing, different from said inlet and outlet openings, sized and shaped to permit passage of at least one of said first and second check valves therethrough;

a cover plate for covering said sealable access opening; and, a flow insert interposed between said cover plate and at least one of said first and second check valves.

2. Apparatus, as claimed in claim 1, wherein said housing is provided in the absence of a bolt-flange coupling between a location of said first shut-off valve and said first check valve.

3. Apparatus, as claimed in claim 1, wherein at least one of said shut-off valves comprises a butterfly valve.

4. Apparatus, as claimed in claim 1, wherein each of said first and second check valves has a valve-motion axis and wherein valve-motion axes of said first and second check valves are substantially collinear.

5. Apparatus, as claimed in claim 1, wherein said first check valve, said second check valve, said first shut-off valve and said second shut-off valve are substantially linearly arranged.

6. Apparatus as claimed in claim 1 wherein said shut-off valves are manually operable.

7. Apparatus as claimed in claim 1 wherein said shut-off valves are hydraulically operable.

8. Apparatus as claimed in claim 1 wherein said shut-off valves are electrically operable.

9. Apparatus, as claimed in claim 1, wherein said flow insert is removable.

10. Apparatus, as claimed in claim 1, wherein said cover plate cooperates with said flow insert to maintain said flow insert in a first position.

11. Apparatus, as claimed in claim 10, wherein said cover plate contacts said flow insert in at least two locations.

12. Apparatus, as claimed in claim 1, wherein said first and second backflow prevention check valves are mechanically independent from one another.

13. A method of providing a double-check-valve backflow preventer, comprising:

providing a housing having at least inlet and outlet openings;

positioning first and second backflow prevention check valves in said housing;

positioning first and second shut-off valves in said housing;

wherein said steps of positioning are performed such that said housing defines a flow path from said inlet opening of said housing, having an upstream pressure, past said first shut-off valve, past said first check valve, past said second check valve, past said second shut-off valve to an outlet opening of said housing, having a downstream pressure, said housing being substantially integral, wherein a housing portion encompassing at least one of said first and second shut-off valves can not be separated from a housing portion encompassing at least one of said check valves without cutting said housing;

moving said check valves from an open configuration to a closed configuration at least if said upstream pressure is not at least a first amount greater than said downstream pressure;

providing an access opening in said housing, different from said inlet and outlet openings, sized and shaped to permit passage of at least one of said first and second check valves therethrough;

substantially sealing said access opening with a cover plate; and, providing a flow insert interposed between said cover plate and at least one of said first and second check valves.

14. A method, as claimed in claim 13, wherein said housing is provided in the absence of a bolt-flange coupling between a location of said first shut-off valve and a location of said first check valve.

15. A method, as claimed in claim 10, wherein positioning of at least one of said shut-off valves comprises positioning a butterfly valve.

16. A method, as claimed in claim 13, wherein each of said first and second check valves has a valve-motion axis and wherein positioning said first and second check valves comprises positioning said first and second check valves such that said valve-motion axes of said first and second check valves are substantially colinear.

17. A method, as claimed in claim 13, wherein positioning said first and second check valves and positioning said first and second shut-off valves comprises positioning said first check valve, said second check valve, said first shut-off valve and said second shut-off valve in a substantially linear arrangement.

18. A method for installing a backflow preventer to inlet and outlet pipes, comprising:

providing a double-check-valve backflow preventer/shut-off valve combination with a substantially unitary housing having an inlet opening and an outlet opening;

coupling said combination to said inlet and outlet pipes by coupling said inlet opening to said inlet pipe and said outlet opening to said outlet pipe in the absence of a need to provide a coupling between a portion of said housing adjacent a first shut-off valve of said combination and a portion of said housing adjacent a first check valve of said combination;

providing an access opening in said housing, different from said inlet and outlet openings;

substantially sealing said access opening with a cover plate; and, providing a flow insert interposed between said cover plate and said first check valve.

19. A double-check-valve backflow preventer apparatus, comprising:

housing means having at least inlet and outlet openings;

first and second backflow prevention check valve means positioned in said housing means;

first and second shut-off valve means positioned in said housing means;

said housing means for defining a flow path from said inlet opening of said housing means, having an upstream pressure, past said first shut-off valve means, past said first check valve means, past said second check valve means, past said second shut-off valve means to an outlet opening of said housing means, having a downstream pressure, said housing means being substantially integral, wherein a first portion of said housing means encompassing at least one of said first and second shut-off valve means can not be separated from a second portion of said housing means encompassing at least one of said check valve means without cutting said housing means;

means for moving said check valves from an open configuration to a closed configuration at least if said upstream pressure is not at least a first amount greater than said downstream pressure;

access means in said housing, different from said inlet and outlet openings, sized and shaped to permit passage of at least one of said first and second check valve means therethrough;

means for substantially sealing said access means;

flow insert means interposed between said sealing means and at least one of said first and second check valve means.

20. Apparatus, as claimed in claim 19, wherein said housing means is provided in the absence of a bolt-flange coupling between a location of said first shut-off valve means and a location of said first check valve means.

21. Apparatus, as claimed in claim 19, wherein at least one of said shut-off valve means comprises a butterfly valve.

22. A double-check-valve backflow preventer apparatus, comprising:

first and second backflow prevention check valves, wherein said first and second backflow prevention check valves are mechanically independent from one another;

first and second shut-off valves;

a housing encompassing said first and second backflow prevention check valves and said first and second manually operable shut-off valves, to define a flow path from an inlet opening of said housing, having an upstream pressure, past said first shut-off valve, past said first check valve, past said second check valve, past said second shut-off valve to an outlet opening of said housing, having a downstream pressure;

said check valves being configured to move from an open configuration to a closed configuration if said upstream pressure is not at least a predetermined amount greater than said downstream pressure;

said housing being substantially integral wherein a housing portion encompassing at least one of said first and second shut-off valves can not be separated from a housing portion encompassing at least one of said check valves without cutting said housing.

23. A method of providing a double-check-valve backflow preventer, comprising:

providing a housing having at least inlet and outlet openings;

positioning first and second backflow prevention check valves in said housing, wherein said first and second backflow prevention check valves are mechanically independent from one another;

positioning first and second shut-off valves in said housing;

wherein said steps of positioning are performed such that said housing defines a flow path from said inlet opening of said housing, having an upstream pressure, past said first shut-off valve, past said first check valve, past said second check valve, past said second shut-off valve to an outlet opening of said housing, having a downstream pressure, said housing being substantially integral, wherein a housing portion encompassing at least one of said first and second shut-off valves can not be separated from a housing portion encompassing at least one of said check valves without cutting said housing;

moving said check valves from an open configuration to a closed configuration at least if said upstream pressure is not at least a first amount greater than said downstream pressure.

* * * * *